United States Patent [19]

Hudson et al.

[11] 4,069,070

[45] Jan. 17, 1978

[54] METHOD OF PRODUCING LOW CARBON TIN-MILL GAGE STEEL WITHOUT ANNEALING BORDER

[75] Inventors: Robert M. Hudson, Churchill Borough; Edward J. Oles, Jr., Pittsburgh; Clair J. Warning, Plum Borough, all of Pa.

[73] Assignee: United States Steel Corporation, Pittsburgh, Pa.

[21] Appl. No.: 633,759

[22] Filed: Nov. 20, 1975

[51] Int. Cl.[2] ..... C21D 1/74; C21D 9/46

[52] U.S. Cl. ..... 148/12.1; 148/12 D

[58] Field of Search ..... 148/12.1, 12 C, 12 D

[56] References Cited

U.S. PATENT DOCUMENTS

| | | | |
|---|---|---|---|
| 2,606,848 | 8/1952 | Farling et al. | 148/12 D |
| 3,653,990 | 4/1972 | Hudson et al. | 148/12.1 |
| 3,700,504 | 10/1972 | Roberts et al. | 148/12 D |
| 3,772,091 | 11/1973 | Mayer et al. | 148/12 D |
| 3,826,693 | 7/1974 | Fisher | 148/12.1 |

*Primary Examiner*—W. Stallard

*Attorney, Agent, or Firm*—Forest C. Sexton

[57] ABSTRACT

The discoloration or off-luster border area called "annealing border" which frequently forms on low carbon tin-mill gage steel coils during box annealing in commercial HNX atmospheres is prevented from forming by providing the steel with less than 0.25 wt. %, and preferably less than 0.20 wt. % free manganese in solid solution.

2 Claims, No Drawings

METHOD OF PRODUCING LOW CARBON TIN-MILL GAGE STEEL WITHOUT ANNEALING BORDER

BACKGROUND OF THE INVENTION

Steels of tin mill gages used in the fabrication of food containers and other applications requiring a quality cold rolled light-gage steel for non deep drawing applications, are usually produced by hot rolling a low-carbon steel to about 0.08 inch, pickling to remove all surface scale, cold rolling and annealing at 1050° to 1400° F. For some applications, the cold rolled and annealed steel may be temper rolled and/or further cold rolled to impart various degrees of stiffness. For applications requiring softer steels, however, the steels are used in the annealed conditions.

For some applications conventional continuous annealing will provide the desired physical characteristics. For optimum softness, however, box annealing is required. In box annealing, coils of the cold rolled steel are stacked with eyes vertical, and an inner cover placed over each of several such stacks. The furnace itself, serving as an outer cover, is placed over several such stacks. A protective atmosphere, typically consisting of nitrogen with 2 to 10% hydrogen, and low in residual water vapor, carbon monoxide and carbon dioxide is admitted under the inner covers to prevent steel oxidation during annealing.

Box annealing as described above, will often cause the formation of an "annealing border" on some coils. This "annealing border" is an off-luster or gray border area which often is particularly severe on the top edge of uppermost coils in the stacks during annealing. Such annealing borders have not been particularly troublesome in steels intended for tin plate applications because the tin coating will cover and hide the discoloration. In other applications, however, the off-luster border may be entirely unacceptable for some customers. Even for some coated applications, such as tin-free chromium-plated steels for food cans, such an annealing border will adversely affect the appearance of the plated steel, and render it unacceptable.

This invention is predicated upon our concerted effort to determine what causes annealing border, and further developments to formulate a process for its prevention during box annealing.

Accordingly, it is an object of this invention to provide a process for producing a soft, low carbon, cold rolled tin-mill gage steel coil without forming an annealing border thereon.

Another object of this invention is to provide a process for preventing the formation of an annealing border on cold rolled tin-mill gage steel coils during box annealing.

A further object of this invention is to provide a new steel composition low in free manganese which is not susceptible to the formation of an annealing border thereon during box annealing.

Black plate (uncoated steel) and tin-free chromium plated light-gage steels as used to produce food containers, where good deep drawing properties are not desired, are usually produced from a conventional Type MR low-carbon steel. The specification for Type MR steel is as follows: 0.12% max. carbon, 0.60% max. manganese, 0.020% max. phosphorus, and 0.20% max. copper. Typically, such steels contain 0.05 to 0.10% carbon, 0.3 to 0.5% manganses, 0.005 to 0.015% phosphorus, 0.01 to 0.03% sulfur, 0.01 to 0.08% silicon, and less than 0.1% of copper, chromium, nickel, molybdenum and other residual elements. During box annealing wherein annealing border may be severe, coils of the above steel are annealed at a temperature of 1050° to 1400° F in a nonoxidizing commerical HNX atmosphere. This atmosphere is a commonly used nonoxidizing annealing atmosphere consisting primarily of nitrogen containing from 2 to 10% hydrogen.

In an extensive study of annealing border, we have discovered that while the conventional HNX atmosphere is nonoxidizing at annealing temperatures to the iron, it is in fact oxidizing to the more readily oxidizable elements such as manganese and silicon. Whereas a high purity HNX atmosphere would not be oxidizing to any elements, the fact is that commerical HNX atmospheres necessarily contain small amounts of water vapor and free oxygen which renders the atmosphere oxidizing to manganese and silicon. During a prolonged box anneal wherein such a commerical atmosphere is constantly supplied, manganese will be oxidized on the steel surface, with such oxidation being most pronounced on steel surfaces closest to the fresh incoming atmosphere. This oxidation results in submicron sized particles on the steel surface which are primarily manganese oxide and/or spinal-type oxides of iron and manganese. As uncombined surface manganese is depleted due to such oxidation, there is some manganese migration to the depleted surface area which results in further manganese oxidation, which is concentrated primarily in the upper edge of the top coil on the stack where temperatures are the highest and access to the atmosphere is greatest. After annealing therefore, some coils, particularly the uppermost coils may have an annealing border, i.e. an off-luster border area which is due to the higher concentration of manganese oxides in the border.

If the annealed coil is subjected to temper rolling or a second cold reduction, the presence of significant amounts of manganese oxides in the border area is visually detectable. During subsequent cleaning and pickling of the steel, if required, the tiny manganese oxide particles are preferentially removed resulting in submicron sized pits, which are again highly concentrated in the border area. Such pits contribute to the off-luster appearance of the border area, even though the oxide particles themselves are no longer present. With heavy coatings such as tin plate, the tiny pits and holes are effectively filled and hence, do not adversely effect the steel's appearance. For chromium plated food containers wherein the plating is very thin, the pits and holes remain visible to yield the undesirable annealing border.

In view of the above discovery, it became apparent that annealing border could be avoided in conventional practices by utilizing a high purity HNX atmosphere which would not be oxidizing even to manganese. Indeed, in the laboratory, ultrapure atmospheres such as very dry hydrogen, i.e. 0.0001% water vapor, and vacuums of $10^{-5}$ torr were sufficient to prevent annealing border on conventional Type MR steel. Unfortunately, these atmosphere conditions are beyond present capabilities in commercial operations, and to create such capability would be extremely costly.

While it is characteristic that all low-carbon steels containing manganese undergo some manganese surface enrichment during annealing, we have learned that the extent of enrichment increases with an increase in the amount of free manganese in solid solution in the steel. It is this manganese that migrates under the above-mentioned preferential oxidation. Accordingly, regardless of the total manganese content, or more specifically regardless of the amount of manganese present in the steel in a combined form as sulfides, oxides, silicates, etc., it is the uncombined free manganese in solid solution which is responsible for annealing border.

The crux of this invention is based on our discovery that if the free manganese in solid solution in the steel is below a level of about 0.23%, and preferably below 0.20%, manganese migration and oxidation in the border area of the coil is minimized to such an extent that no visible annealing border is formed. In accordance with the practice of this invention, low-carbon light-gage steel for food containers and other applications not requiring good deep drawing properties is produced in accordance with conventional prior art practice, except that the steel's free manganese content is essentially controlled to an amount of about 0.23% or less. With such a low free manganese content, the cold rolled steel can be readily annealed in commercial HNX atmospheres without the formation of visible annealing border. More specifically, the process involves formation of a steel containing 0.12% max. carbon, 0.020% max. phosphorus, 0.050% max. sulfur, and 0.08% max. silicon. The free manganese content, as noted is limited to a maximum of about 0.23% and preferably below 0.20%. This steel is then hot rolled, pickled, and cold rolled according to conventional prior art practices. Coils of this cold rolled steel are then box annealed at 1050° to 1400° F in a commercial HNX atmosphere without the formation of any visible annealing border.

In view of the fact that the total manganese content in these low-carbon steels is already relatively low, e.g. 0.3 to 0.6%, one might expect that the free manganese content, which is a fraction of the total manganese, would normally be within the desired range. Contrary thereto, we have learned that the free manganese content in these low-carbon light-gage steels is a dominating proportion of the total. For example, in a Type MR open hearth steel, wherein the total manganese will range from 0.3 to 0.6%, anywhere from 0.07 to 0.15% is tied-up in manganese compounds, i.e. sulfides, oxides and/or silicates, with the balance as free manganese, i.e. typically from 0.25 to 0.5%. In other steels the proportion of free manganese may be even greater. For example, in continuous cast low-carbon steels intended for food cans, about 0.05% manganese is present in combined form with the entire balance as free manganese.

In producing low-carbon steels for sheet and tin mill applications, it is common practice to deoxidize the steel with ferromanganese in combination with silicon and/or aluminum. This manganese is the major source of the total manganese in the steel. Therefore, the exceptionally low free manganese contents as required by this invention can be readily achieved by altering the deoxidation practice, i.e. by reducing the amount of ferromanganese used and increasing the amount of silicon and/or aluminum. For example, a continuous-cast steel with 0.04% Si could have total manganese lowered from 0.40 to 0.25 by increasing the aluminum from 0.005 to 0.015%.

The following experiment is presented to better illustrate the advantages of this invention. In this experiment eight low carbon sheet steels were examined, each of which contained a different amount of free manganese, i.e. manganese in solid solution, ranging from 0.13 to 0.33 wt. %. But for the variations in manganese content all steels were substantially identical Type MR steels processed to cold rolled sheet coils in accordance with the same prior art practice as noted above. Each of these coils were box annealed at from 1200° to 1240° F in a commerical HNX atmosphere containing 6% hydrogen, 0.013% water vapor and a balance of nitrogen and normal impurities. Each coil was placed in the same uppermost position for box annealing as is most susceptible to formation of annealing border. After annealing, visual observations were made on the coil's most susceptible edge to determine the extent of annealing border, if any. The results are shown in the table below.

Table

Intensity of Annealing Border Observed on Top Edge of Commercially Annealed Coils Located in Top Stool Positions

| | Examination of Annealed Coils | | | | Analyses Made on Steel Before Annealing | | | |
|---|---|---|---|---|---|---|---|---|
| | Intensity of Annealing Border | | | | | Combined Mn in Steel, percent | | |
| Coil No. | Outer Portion of Coil | Middle Portion of Coil | Inner Portion of Coil | Surface Manganese (2000A Layer) After Annealing in Border Area, percent | Total Mn, percent | as Sulfide | as MnO or MnO . $SiO_2$ | Manganese in Solid Solution, percent |
| 1 | None | None | None | 2.3 | 0.28 | 0.031 | 0.114 | 0.13 |
| 2 | None | None | None | 2.4 | 0.24 | 0.013 | 0.077 | 0.15 |
| 3 | None | None | None | 2.9 | 0.38 | 0.049 | 0.105 | 0.22 |
| 4 | None | None | Light | 3.4 | 0.31 | 0.031 | 0.054 | 0.23 |
| 5 | Very light | Heavy | Heavy | 4.1 | 0.41 | 0.041 | 0.097 | 0.27 |
| 6 | Heavy | Heavy | Heavy | 4.3 | 0.37 | 0.021 | 0.056 | 0.29 |
| 7 | Heavy | Heavy | Heavy | 4.5 | 0.41 | 0.024 | 0.096 | 0.29 |
| 8 | Heavy | Heavy | Heavy | 5.6 | 0.43 | 0.036 | 0.065 | 0.33 |

From the table it can be seen that those coils containing 0.27 wt. % free manganese or more were susceptible to a very prominent annealing border termed as "heavy" in the table. At free manganese contents of from 0.20 to 0.23 wt. % however, the worst affect was only a slight annealing border. Those coils having less than 0.20 wt. % free manganese did not exhibit any visible annealing border whatsoever.

What reference to the above table, that column showing the surface manganese is particularly interesting, as it illustrates the extent of manganese migration into the border area during annealing.

We claim:

1. In the process for producing a cold rolled tin-mill gage steel coil wherein a low-carbon steel is hot rolled, pickled, cold rolled to final gage and box annealed at a temperature of 1050° to 1400° F in a commercial HNX atmosphere; the improvement comprising preventing the formation of an annealing border on the steel coil during the anneal by providing the steel with a manganese content such that the free manganese in solid solution is less than about 0.23 weight percent.

2. The process according to claim 1 in which the free manganese in solid solution is less than 0.20 weight percent.

* * * * *